US006336841B1

(12) United States Patent
Chang

(10) Patent No.: US 6,336,841 B1
(45) Date of Patent: Jan. 8, 2002

(54) METHOD OF CMP ENDPOINT DETECTION

(75) Inventor: Ping-Yi Chang, Kaohsiung Hsien (TW)

(73) Assignee: Macronix International Co. Ltd., Hsin-Chu (TW)

( * ) Notice: Subject to any disclaimer, the term of this patent is extended or adjusted under 35 U.S.C. 154(b) by 0 days.

(21) Appl. No.: 09/820,304

(22) Filed: Mar. 29, 2001

(51) Int. Cl.[7] ..... B24B 49/00

(52) U.S. Cl. ..... 451/10; 451/5; 451/6; 451/11; 451/41; 451/63

(58) Field of Search ..... 451/5, 6, 9, 10, 451/11, 41, 54, 59, 63; 438/692, 693

(56) References Cited

U.S. PATENT DOCUMENTS 5,609,511 A * 3/1997 Moriyama et al. ..... 451/5
6,071,177 A * 6/2000 Lin et al. ..... 451/6
6,077,452 A * 6/2000 Litvak ..... 216/85
6,106,662 A * 8/2000 Bibby et al. ..... 156/345
6,224,460 B1 * 5/2001 Dunton et al. ..... 451/6
6,254,459 B1 * 7/2001 Bajaj et al. ..... 451/41
6,261,155 B1 * 7/2001 Jairath et al. ..... 451/41
6,280,289 B1 * 8/2001 Wiswesser et al. ..... 451/6
6,280,290 B1 * 8/2001 Birang et al. ..... 451/6
6,287,879 B1 * 9/2001 Gonzales et al. ..... 438/16
6,290,572 B1 * 9/2001 Hofmann ..... 451/5

* cited by examiner

*Primary Examiner*—Eileen P. Morgan
(74) *Attorney, Agent, or Firm*—Winston Hsu

(57) ABSTRACT

The present invention provides an infrared spectroscopic method of removing a first layer from a semiconductor wafer without overpolishing the underlying second layer. The first layer and the second layer of the semiconductor wafer is subjected to infrared (IR) spectroscopy and an absorbance curve is produced, whereby each layer absorbs IR light at different wavenumbers to produce different absorbance peaks. Once the CMP process is performed, a change in the IR absorptivity and thus the absorbance peak of each layer is detected. The endpoint of the CMP process is determined at a point when significant change in the IR absorptivity of the first layer is no longer detected and change in the IR absorptivity of the second layer occurs.

10 Claims, 3 Drawing Sheets

METHOD OF CMP ENDPOINT DETECTION

BACKGROUND OF THE INVENTION

1. Field of the Invention

The present invention relates to a method of determining the endpoint of a chemical mechanical polishing (CMP) process, and more particularly, to a method of CMP endpoint detection involving the use of infrared spectroscopy.

2. Description of the Prior Art

Chemical mechanical polishing is a common method used in the semiconductor industry to planarize the surface of a semiconductor wafer. For example, it can be used to remove a first layer of a dual layer surface. Several methods are available for determining the endpoint of the CMP process, with the most common being optically monitoring a target layer. However, the target layer is required to be of a sufficient thickness so that during the CMP process, data can be detected by the photo detector of the intensity of a reflected light beam to produce a trace curve of which is then used to determine the CMP endpoint. Generally, the thickness of the target layer is required to be greater than 3000 angstroms so that the data generated by the reflecting light beam produces a trace curve.

Please refer to FIG. 1 of the schematic diagram of the method used to determine the CMP endpoint according to the prior art. As shown in FIG. 1, an unpolished semiconductor wafer 11 is positioned within a holder 13 of a wafer head 15. Beneath the wafer 11 is a polishing pad 12 supported by a polishing platen 16, with a window (not shown) penetrating both the pad 12 and the platen 16 to the surface of the target layer of the semiconductor wafer 11. A motor 19 drives both the wafer head 15 and the polishing platen 16, while a controller 18 controls both their rotational speeds. A vertical motor 20 is positioned for the vertical contacts between the wafer head 15 and the polishing platen 16. In addition, the equipment of the CMP process also includes a slurry supplier tube 14, to transfer a flow of slurry between the semiconductor wafer 11 and the polishing pad 12.

During the CMP process, the wafer head 15 and the polishing platen 16 both rotate, respectively, at a specified rate of speed to allow the slurry to smoothly spray the polishing pad 12. With the proper parameter settings, the target layer of the semiconductor wafer 11 can be polished via the chemical reaction produced between the slurry and the mechanical polishing of the polishing pad 12. The CMP endpoint detecting system of the prior art determines the polishing endpoint by a trace curve 22, processed by a computer 21, of the light beam reflected from the target layer. More specifically, the equipment of the CMP process of the prior art includes an optical detecting device 17 to generate a light beam of a specific wavenumber. The light beam passes through the hole of the polishing pad 12 and is directed onto the target layer of the semiconductor wafer 11 at a predetermined angle. The intensity of the reflected light beam can be continually detected by the optical detecting device 17. Then, the data is transmitted to the controller 18 and the computer 21 where the result is shown as a trace curve 22 on the computer screen. From the trace curve 22, the CMP endpoint is then determined by the use of predetermined window logics 51 and 52 during abrupt changes in the intensity I of the reflected light.

However, the prior art method of determining the endpoint of the CMP process requires a target layer of a thickness above 3000 angstroms in order to produce a computer-generated trace curve, which is then used to detect the CMP endpoint.

SUMMARY OF THE INVENTION

It is therefore a primary objective of the present invention to provide a novel method of CMP endpoint detection without the need for a specific target layer thickness.

In a preferred embodiment, the present invention provides an infrared spectroscopic method of removing a first layer from a semiconductor wafer without overpolishing the underlying second layer. The first layer and the second layer of the semiconductor wafer are composed of silicon oxide or silicon nitride. An infrared (IR) light source is directed onto the semiconductor wafer, and data related to IR absorptivity of each layer is collected to produce a standard IR absorbance curve for each layer of the semiconductor wafer. Since each layer absorbs IR light at different wavenumbers, two defined IR absorbance curves are observed whereby once the CMP process is performed, a change in the IR absorptivity and thus the absorbance curve of each layer is detected. The IR absorptivity of the first layer progressively decreases for a length of time until significant change in the absorbance curve is no longer detected. The endpoint of the CMP process is determined at a point when significant change in the IR absorptivity of the first layer is no longer detected and change in the IR absorptivity of the second layer occurs.

It is an advantage of the present invention that the endpoint of the CMP process is easily and precisely determined via infrared spectroscopy, whereby removal of a first layer exposes, but does not overpolish, the underlying second layer of a semiconductor wafer.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
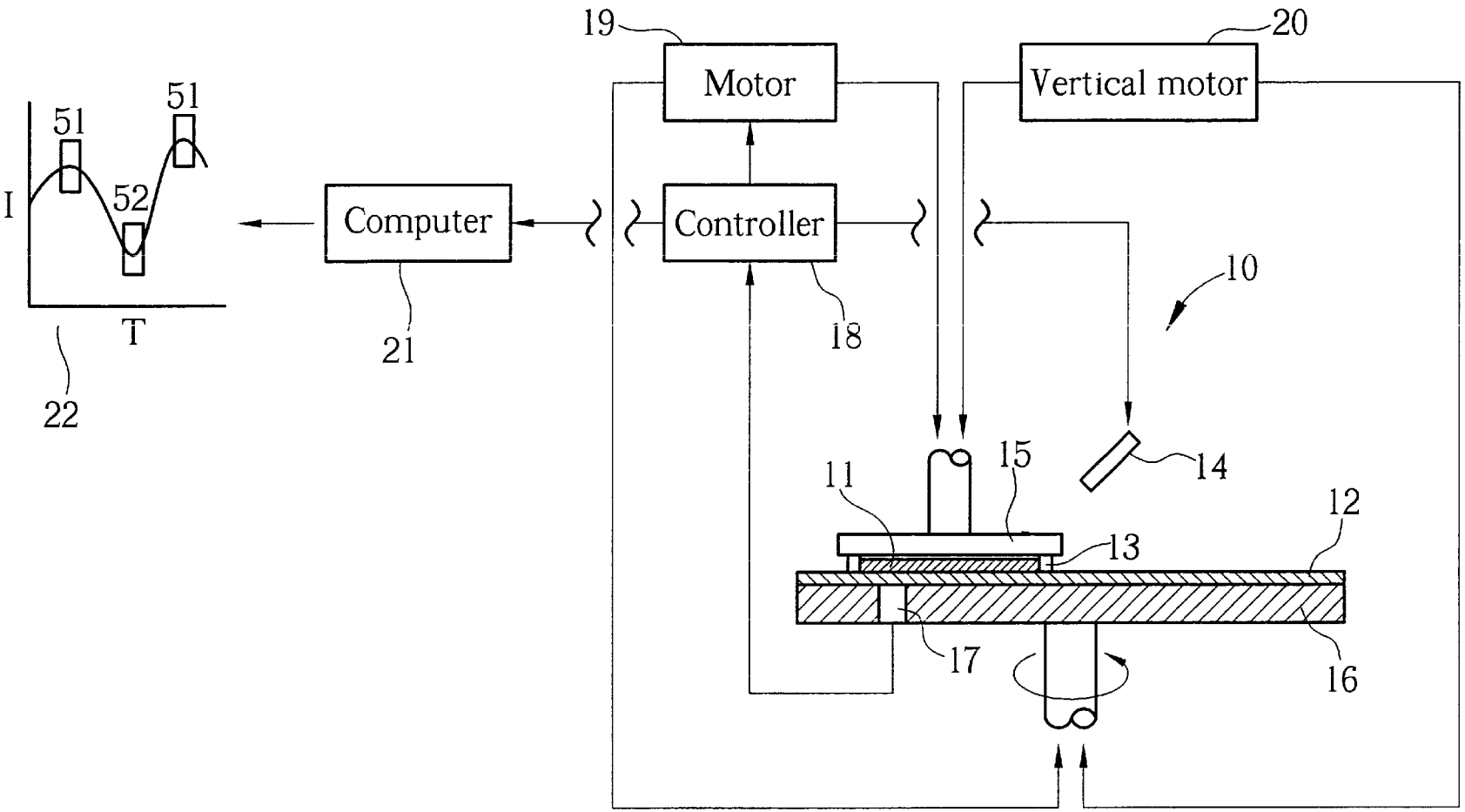
Fig. 1 Prior art
FIG. 1 is a schematic diagram of a method of determining the CMP endpoint according to the prior art.
Figure 2:
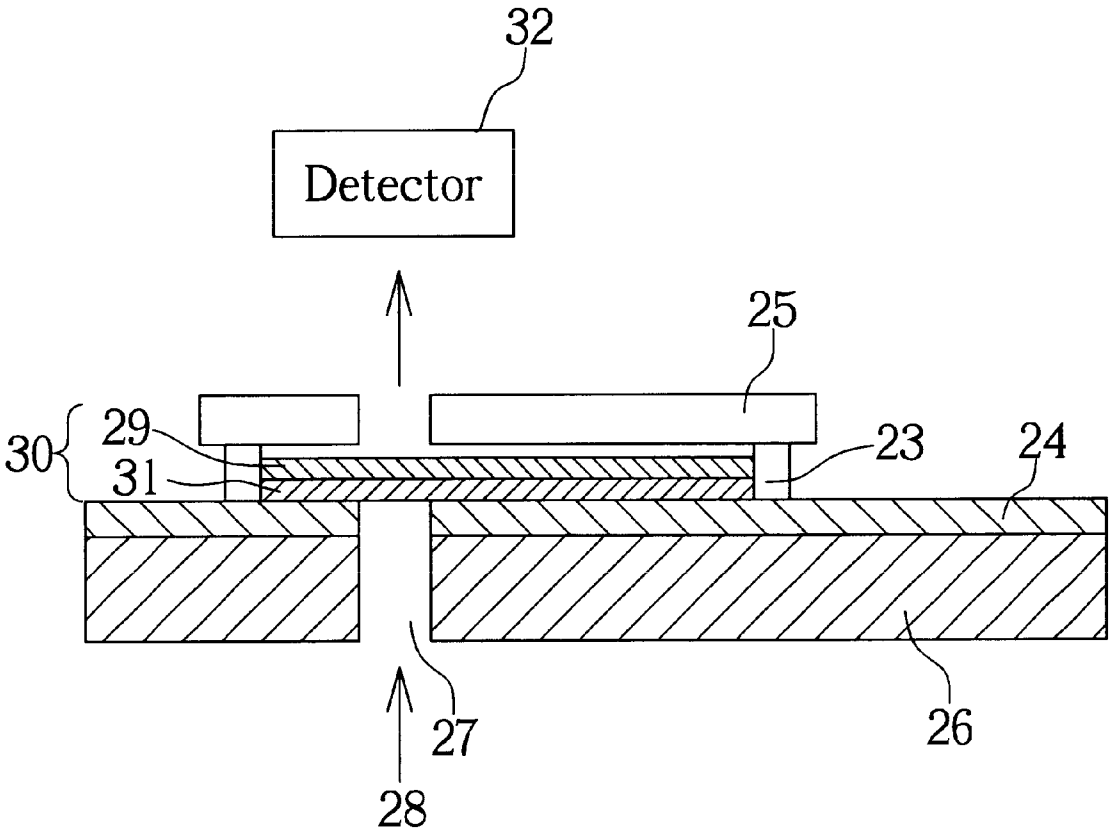
FIG. 2 is a schematic diagram of a method of determining the CMP endpoint according to the present invention.

Please refer to FIG. 2 of a schematic diagram of a method of determining the CMP endpoint according to the present invention. As shown in FIG. 2, a semiconductor wafer 30 is placed in a holder 23 and fixed in position by a wafer head 25. The semiconductor wafer 30 rests atop a polishing pad 24 positioned on a platen 26. The semiconductor wafer 30 has a first layer 31 and a second layer 29. The first layer 31 and second layer 29 are each composed of silicon oxide or silicon nitride, of which both are transparent to infrared (IR) light and absorb IR light at different wavenumbers. An infrared light source 28, is directed onto a window 27 which allows IR light from the IR light source 28 to pass through the platen 26, the polishing pad 24, the semiconductor wafer 30, and the wafer head 25 to a detector 32. The detector 32 then produces a graph, per period of the polishing pad 24, displaying the IR absorptivity of both the silicon oxide and the silicon nitride of the semiconductor wafer 30 during the course of the CMP process. Thus, a graph displaying changes in IR absorptivity of the first layer 31 and second layer 29 is produced at a constant interval of time with a per unit time of milliseconds.

Figure 3:
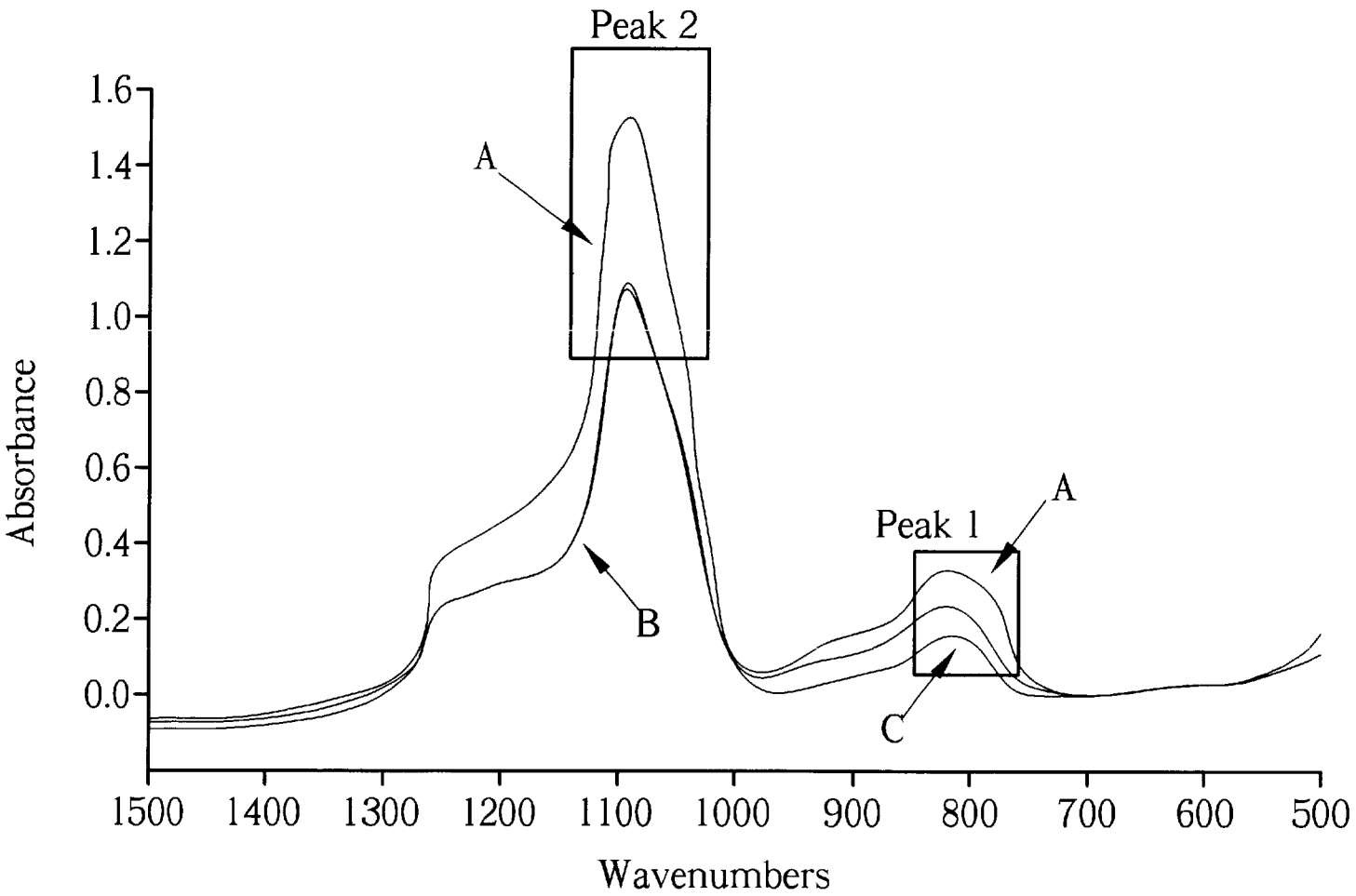
FIG. 3 is a graph illustrating the IR absorptivity versus wavenumber of silicon oxide and silicon nitride throughout the course of the CMP process, according to the present invention.

Please refer to FIG. 3 of the graph illustrating the IR absorptivity versus wavenumber of silicon oxide and silicon nitride throughout the course of the CMP process, according to the present invention. As shown in FIG. 3, the beginning of the CMP process is shown by an absorbance curve A which is shown having two distinct peaks 1,2. Each peak represents IR absorptivity of each layer. For instance, the absorbance peak 2 of the first layer, composed of silicon oxide, is detected at a wavenumber between 1100–1000cm$^{-1}$ with an absorbance value at approximately 1.5. The absorbance peak 1 of the second layer, composed of silicon nitride, is detected at a wavenumber of approximately 850–750cm$^{-1}$ and with an absorbance value at approximately 0.3.

During progression of the CMP process, the absorbance curve decreases as shown by curves B and C of FIG. 3. At one point, peak 2 of the absorbance curve C does not show a significant decrease. At this point the CMP process is at its endpoint since significant change in peak 2 of the silicon oxide, which is signalled by a three-point decrease in the slope of peak 2, is no longer observed and is followed by the subsequent decrease in the IR absorptivity and therefore the absorbance peak 1 of the silicon nitride of the second layer. A lack of significant change in the absorbance peak 2 of the silicon oxide in combination with a beginning decrease in the absorbance peak 1 of the silicon nitride, signifies the endpoint of the CMP process. Since peak 1 shows a marked decrease from curve B to curve C, overpolishing of the second layer has occurred. Therefore, the CMP endpoint is determined to be at a point between curves B and C.

However, instead of the first layer being composed of silicon oxide and the second layer being composed of silicon nitride, they can be reversed so that the first layer is composed of silicon nitride and the second layer is composed of silicon oxide. At this point the CMP process is at its endpoint when no significant change occurs in the IR absorbance peak of the silicon nitride layer in combination with a decrease in the IR absorbance peak of the silicon oxide layer.

As well, the method of the present invention can also be used in a shallow trench isolation (STI) CMP process to remove a dielectric layer composed of silicon oxide so as to expose a stop layer, composed of silicon nitride, directly underlying the dielectric layer. The endpoint of the STI CMP process is therefore determined when a lack of significant change in the IR absorbance peak of the dielectric layer occurs in combination with a decrease in the IR absorbance peak of the stop layer.

In contrast to the prior art, the present invention provides an effective and simplified method of determining the endpoint of the CMP process whereby IR absorptivity is used to detect the removal of a first layer of a semiconductor wafer without overpolishing the underlying second layer. As well, in the prior art, a first layer of a thickness greater than 3000 angstroms is required to determine the CMP endpoint since a thickness less than 3000 angstroms will not produce a trace curve of which is used to detect the CMP endpoint. However, the method of the present invention does not require a first layer of a specified thickness.

Those skilled in the art will readily observe that numerous modifications and alterations of the device may be made while retaining the teachings of the invention. Accordingly, the above disclosure should be construed as limited only by the metes and bound of the appended claims.

What is claimed is:

1. A method of determining an endpoint of a chemical mechanical polishing (CMP) process applied to a semiconductor wafer to remove a first layer directly atop a second layer on a first side of the semiconductor wafer, the first and second layer each absorbing infrared (IR) light at different wavelengths, the method comprising:

directing an IR light source onto the first side of the semiconductor wafer;

detecting transmitted IR light received by an IR detector located on a second side of the semiconductor wafer;

graphing IR absorptivity of the first layer and the second layer;

performing the CMP process and using the IR absorptivity of the first layer and the second layer to produce an IR absorbance curve;and determining the endpoint of the CMP process, wherein the endpoint of the CMP process is determined at a point when a lack of significant change in the IR absorptivity of the first layer occurs in combination with a decrease in the IR absorptivity of the second layer.

2. The method of claim 1 wherein the first layer and the second layer is a non-metal layer.

3. The method of claim 2 wherein the first layer and the second layer is a silicon oxide or a silicon nitride layer.

4. The method of claim 1 wherein detection of the IR absorptivity of both the first layer and the second layer is through the use of infrared spectroscopy.

5. The method of claim 1 wherein decrease in the IR absorptivity of the first layer occurs prior to the decrease in the IR absorptivity of the second layer.

6. A method of determining an endpoint of a shallow trench isolation (STI) chemical mechanical polishing (CMP) process applied to a semiconductor wafer to remove a dielectric layer directly atop a stop layer on a first side of the semiconductor wafer, the dielectric layer and the stop layer each absorbing infrared (IR) light a different wavelengths, the method comprising:

directing an IR light source on the first side of the semiconductor wafer;

detecting transmitted IR light received by an IR detector located on a second side of the semiconductor wafer;

graphing IR absorptivity of the dielectric layer and the stop layer;

performing the CMP process and using the IR absorptivity of the dielectric layer and the stop layer to produce a corresponding IR absorbance curve;and determining the endpoint of the CMP process, wherein the endpoint of the CMP process is determined at a point when a lack of significant change in the IR absorptivity of the dielectric layer occurs in combination with a decrease in the IR absorptivity of the stop layer.

7. The method of claim 6 wherein the dielectric layer is composed of silicon oxide.

8. The method of claim 6 wherein the stop layer is composed of silicon nitride.

9. The method of claim 6 wherein detection of the IR absorptivity of both the dielectric layer and the stop layer is through the use of infrared spectroscopy.

10. The method of claim 6 wherein decrease in the IR absorptivity of the dielectric layer occurs prior to the decrease in the IR absorptivity of the stop layer.

* * * * *